US006376432B1

(12) United States Patent
Leslie et al.

(10) Patent No.: US 6,376,432 B1
(45) Date of Patent: Apr. 23, 2002

(54) LOW FRICTION GREASE FOR CONSTANT VELOCITY UNIVERSAL JOINTS, PARTICULARLY PLUNGING TYPE JOINTS THAT IS COMPATIBLE WITH SILICONE ELASTOMER BOOTS

(75) Inventors: Walter Logan Leslie, Lee's Summit, MO (US); Jon Carl Root, Leawood, KS (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/817,415

(22) Filed: Mar. 26, 2001

(51) Int. Cl.[7] ..... C10M 169/06; C10M 115/08

(52) U.S. Cl. ..... 508/137; 508/156; 508/364; 508/365; 508/552; 508/569

(58) Field of Search ..... 508/137, 552

(56) References Cited

U.S. PATENT DOCUMENTS

| | | | | | |
|---|---|---|---|---|---|
| 4,298,481 | A | * | 11/1981 | Clarke | 252/21 |
| 4,759,859 | A | * | 7/1988 | Waynick | 252/18 |
| 4,986,923 | A | * | 1/1991 | Waynick | 252/25 |
| 5,585,336 | A | * | 12/1996 | Ozaki et al. | 508/365 |
| 5,589,444 | A | * | 12/1996 | Hatakeyama | 508/168 |
| 5,604,187 | A | * | 2/1997 | Takeuchi et al. | 508/168 |
| 5,607,906 | A | * | 3/1997 | Okaniwa et al. | 508/168 |
| 5,650,380 | A | * | 7/1997 | Fletcher | 508/168 |
| 6,022,835 | A | * | 2/2000 | Fletcher | 508/365 |
| 6,037,314 | A | * | 3/2000 | Kondo et al. | 508/363 |
| 6,258,760 | B1 | * | 7/2001 | Ozaki et al. | 508/365 |

* cited by examiner

*Primary Examiner*—Ellen M. McAvoy
(74) *Attorney, Agent, or Firm*—Joseph J. Allocca

(57) ABSTRACT

A silicon elastomer compatible constant velocity joint grease comprises a urea grease composed of a lubricating oil and a urea thickener and an effective amount of a friction reducing additive package comprising vermiculite, molybdenum oxysulfide dithiocarbamate, polyphenylene sulfide and potassium triborate. The additive package solids have particle sizes below about 40 microns.

7 Claims, No Drawings

LOW FRICTION GREASE FOR CONSTANT VELOCITY UNIVERSAL JOINTS, PARTICULARLY PLUNGING TYPE JOINTS THAT IS COMPATIBLE WITH SILICONE ELASTOMER BOOTS

FIELD OF INVENTION

The present invention relates to a grease composition particularly useful in drive joints of front wheel drive vehicles.

BACKGROUND OF INVENTION

Front wheel drive vehicles employ front drive joints often referred to as constant velocity joints (CVJ) which require lubricating the joint to protect against wear, to reduce friction and vibration and to increase the life of the joint.

One type of CVJ lubricant is a grease composition comprising a purified mineral oil, as a base oil, and a lithium soap as a thickening agent. Another type of grease used for CVJ comprise a base oil and a urea type thickener.

CVJs experience significant pressures, torques and loads in use. Consequently, CVJ grease compositions typically contain extreme pressure additives such as molybdenum disulfide, molybdenum dithiocarbamates, sulfurized fats and oils and olefin sulfides.

A prime requirement for CVJ greases is that they be compatible with the elastomers and seals used in these joints.

To provide a CVJ grease with low friction properties additives such as ashless dithiophosphate and zinc dithiophosphate are often employed. These additives, however, are incompatible with silicone elastomers used and seals in many constant velocity joints.

One object of the present invention is to provide an improved, silicone elastomer compatible, grease, especially a low friction CVJ grease.

Other objects will become apparent upon a reading of the specification that follows.

SUMMARY OF INVENTION

The improved grease composition of the invention is compatible with silicone elastomers and is particularly useful for CVJs. The grease composition comprises a urea grease composed of a lubricating oil and a urea thickener and an effective amount of a friction reducing additive package comprising vermiculite, molybdenum oxysulfide dithiocarbamate and potassium triborate, the additive package solids having particles sizes below about 40 microns and preferably below about 10 microns.

DETAILED DESCRIPTION OF THE INVENTION

The base oil used in the practice of the present invention may be a mineral oil or a synthetic hydrocarbon oil having a viscosity of a lubricant. Examples of mineral oil include 60 neutral oil, 100 neutral oil, 150 neutral oil, 300 neutral oil, 500 neutral oil, bright stock naphthenic oils and blends. Examples of synthetic oils include polyalphaolefin, polyglycol, polyolester, polyphosphoric acid ester, silicone oil, alkyldiphenyl, alkylbenzene, and dibasic acid ester. These base oils may be used alone or in the form of a mixture of two or more of them. It is particularly preferred in the practice of the present invention to use a mixture of bright stock and polyalpha olefin oils.

The base oil will comprise a major portion of the grease composition. For example the base oil typically will be in the range of about 65 to about 95 wt %, based on the total weight of the composition.

The grease composition of the present invention includes a urea thickener. Typical thickeners include diurea and triurea compounds and higher polyurea compounds.

Examples of diurea compounds include those obtained through a reaction of a monoamine with a diisocynate. Examples of diisocyanates include diphenyl diisocyanate, octadecene diisocynate and the like. Examples of monoamines include octylamine, dodecylamine, hexadecylamine and the like.

Among the higher polyurea compounds useful in the practice of the present invention are those obtained by the reaction of an amine with a diisocyante compound such as those mentioned above.

In the practice of the present invention it is preferred to use the urea thickener in an amount ranging from about 2.5 wt % to about 30 wt % based on the total weight of the composition.

The grease of the invention includes an effective amount of a friction reducing additive package comprising vermiculite, molybdenum oxysulfide dithiocarbamate, polyphenylene sulfide, and potassium triborate, the additive package having particle sizes below about 40 microns and preferably below about 10 microns, and even as low as 1 micron or less.

The vermiculite component of the additive package is a powdered thermally expanded magnesium-iron aluminum silicate.

The molybdenum oxysulfide dithiocarbamate of the additive package is a compound represented by the formula:

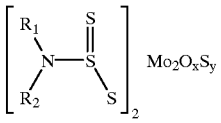

wherein each of $R_1$ and $R_2$ are independently an alkyl group of from 1 to 24 carbon atoms, an aryl group or alkylaryl group of from 6 to 16 carbon atoms and wherein x and y are numerical values greater than zero and less than 4 and the sum of x and y is 4.

The polyphenylene sulfide or poly (1,4-phenylene sulfide) used in the additive package is a thermoplastic, injection molding resin available in powdered form.

The potassium triborate used in the additive package is an amorphous inorganic solid. A commercially available suspension of the triborate in an oil has been found to be a useful component in the additive package.

Typically the weight ratio of vermiculite:molybdenum oxysulfide dithiocarbamate:polyphenylene sulfide:potassium triborate will be in the range of about 0.5:2:1:1 to about 5:20:10:10, and preferably 1:3:2:2.

Also, the additive package will comprise about 0.5 to about 30 wt % of the total composition.

EXAMPLES

A grease was formulated by compounding the ingredients shown in Table 1.

TABLE 1

| Component | Type | Supplier | Wt % |
|---|---|---|---|
| Base Oil | Bright stock/PAO | NA | 71.74 |
| Thickener | Polyruea | NA | 12.26 |
| FPSV | Vermiculite Molybdenum | W. R. Grace | 2.0 |
| Molyvan A | Oxysulfide Dithiocarbamate | R. T. Vanderbilt | 6.0 |
| Oloa 9750[1] | Potassium triborate | Chevron | 4.0 |
| Ryton Type VT | Polyphenylene Sulfide | Phillips 66 | 4.0 |

NA - not applicable
[1]Oloa 9750 is a suspension of potassium borate in an oil.

The physical properties of the grease are set forth in Table 2.

TABLE 2

| Physical Properties | Test Methods | Test Results |
|---|---|---|
| Penetration, 60X | ASTM D-217 | 312 dmm |
| Cold Penetration, 6 hours @ −40° C. | ASTM D-217 (modified) | 165 dmm |
| Dropping Point, ° C. (° F.) | ASTM D-2265 | 255° C. (491° F.) |
| Oil Separation (%), 24 hours @ 100° C. | FTM 791C/321.3 | 2.0% |
| Evaporation (%), 22 hours @ 99° C. | ASTM D-972 | 0.33% |
| $O_2$ Stability, 100 hours KPa drop | ASTM D-942 | 21 KPa |
| Copper Strip Corrosion, 1 hour @ 150° C. | ASTM D-4048 | 1B |
| Low Temperature Torque, −40° C. starting N•m | ASTM D-4693 | 7.88 N•m |
| Timken EP | ASTM D-2509 | 45 lbs. |
| 4 Ball EP | ASTM D-2596 | 315 kg |
| Corrosion Prevention | ASTM D-1743 | Pass |
| 4 Ball Wear @ 75° C. scar diameter, mm | ASTM D-2266 | 0.41 mm |
| Base Oil Viscosity | | |
| @100° C., cSt | Calculated | 11.4 |
| @40° C., cSt | Calculated | 107 |
| Viscosity index | Calculated | 92 |

The elastomer compatibility of the grease was determined by immersing elastomer samples in the grease for times and at the temperatures shown in Table 3 and thereafter measuring the change in elongation and tensile strength of the sample using an Instron tester at a load of 200 lbs. and a cross-head speed of 2 inches/minute for the Hytrel elastomer samples and 100 lbs. and 20 inches/minute for the silicon elastomer samples.

TABLE 3

| Elastomer | Test Conditions | % Change, Elongation | % Change, Tensile |
|---|---|---|---|
| Silicone | Total Immersion 13 days @ 150° C. | −9.09 | −13.17 |
| Hytrel | Total Immersion 10 days @ 125° C. | +1.33 | −11.49 |

What is claimed is:

1. A grease composition for a constant velocity joint comprising a urea grease composed of a lubricating oil and a urea thickener and containing an effective amount of a friction reducing additive package comprising vermiculite, molybdenum oxysulfide dithiocarbamate, polyphenylene sulfide and potassium triborate.

2. The composition of claim 1 wherein the additive package has particle sizes below about 40 microns.

3. The composition of claim 2 wherein the particle sizes are below about 10 microns.

4. The composition of claim 2 wherein the ratio of vermiculite:molybdenum oxysulfide dithiocarbamate-:polyphenylene sulfide:potassium triborate is in the range of about 0.5:2:1:1 to about 5:20:10:10.

5. The composition of claim 4 wherein the additive package comprises from about 0.5 to about 30 wt % of the total grease composition.

6. A grease for constant velocity joints comprising:

from about 65 to about 95 wt % of a base oil;

from about 2.5 to about 30 wt % of a urea thickener; and from about 0.5 to about 30 wt % of an additive package consisting essentially of vermiculite; molybdenum oxysulfide dithiocarbamate; polyphenylene sulfide; and potassium triborate suspended in an oil, the additives having particle sizes below about 10 microns and present in the package a weight ratio of vermiculite:dithiocarbamate:polyphenylene sulfide:triborate in the range of about 0.5:2:1:1 to about 5:20:10:10.

7. The grease of claim 6 wherein the additives in the package are present in a ratio of 1:3:2:2.

* * * * *